US009751086B2

(12) United States Patent
Kajihara et al.

(10) Patent No.: US 9,751,086 B2
(45) Date of Patent: Sep. 5, 2017

(54) GRAIN-MILLING MACHINE

(71) Applicant: SATAKE CORPORATION, Chiyoda-ku, Tokyo (JP)

(72) Inventors: Kazunobu Kajihara, Tokyo (JP); Yoichiro Ogura, Tokyo (JP); Tsutomu Hako, Tokyo (JP); Yoji Kashiwa, Tokyo (JP); Somchai Keawkaika, Tokyo (JP); Kazuto Nonaka, Tokyo (JP); Shin Saeki, Tokyo (JP)

(73) Assignee: SATAKE CORPORATION, Chiyoda-Ku, Tokyo (JP)

( * ) Notice: Subject to any disclaimer, the term of this patent is extended or adjusted under 35 U.S.C. 154(b) by 445 days.

(21) Appl. No.: 14/400,402

(22) PCT Filed: Jun. 4, 2013

(86) PCT No.: PCT/JP2013/065479
§ 371 (c)(1),
(2) Date: Nov. 11, 2014

(87) PCT Pub. No.: WO2013/183638
PCT Pub. Date: Dec. 12, 2013

(65) Prior Publication Data

US 2015/0122924 A1 May 7, 2015

(30) Foreign Application Priority Data

Jun. 4, 2012 (JP) ..... 2012-127347

(51) Int. Cl.
*B02C 9/00* (2006.01)
*B02B 5/02* (2006.01)
(Continued)

(52) U.S. Cl.
CPC ..... *B02B 5/02* (2013.01); *B02B 3/04* (2013.01); *B02B 7/02* (2013.01); *B02C 9/00* (2013.01); *B02C 9/04* (2013.01)

(58) Field of Classification Search
CPC .... B02C 9/00; B02C 9/04; B02B 5/02; B02B 7/02; B02B 3/04
(Continued)

(56) References Cited

U.S. PATENT DOCUMENTS 4,324,175 A 4/1982 Satake et al.
5,025,993 A * 6/1991 Satake ..... B02C 9/04 241/74
(Continued)

FOREIGN PATENT DOCUMENTS

CN 1313146 A 9/2001
CN 201493126 U 6/2010
(Continued)

OTHER PUBLICATIONS

Office Action, The State Intellectual Property Office of the People's Republic of China, 100037, Mar. 17, 2016.
(Continued)

*Primary Examiner* — Faye Francis
(74) *Attorney, Agent, or Firm* — Taft Stettinius & Hollister LLP

(57) ABSTRACT

An abrasive grain-milling unit and a friction grain-milling unit are located on upper and lower portions of a pedestal, respectively. The friction grain-milling unit includes a grain feed trough to which a milled grain discharge trough of the abrasive grain milling unit is connected. A two-way grain feed trough and change-over valve is located above the abrasive grain-milling unit and is capable of selectively
(Continued)

feeding grains either directly to the friction grain-milling unit or to the friction grain-milling unit via the abrasive grain-milling unit.

2 Claims, 2 Drawing Sheets

(51) Int. Cl.
*B02C 9/04* (2006.01)
*B02B 3/04* (2006.01)
*B02B 7/02* (2006.01)

(58) Field of Classification Search
USPC ..... 241/74, 152.2, 6–13
See application file for complete search history.

(56) References Cited

U.S. PATENT DOCUMENTS 5,048,407 A * 9/1991 Salete-Garces ..... B02B 3/04 99/519
5,295,629 A * 3/1994 Satake ..... B02B 3/04 241/257.1
5,394,792 A * 3/1995 Satake ..... B02B 3/04 99/519
5,395,059 A * 3/1995 Satake ..... B02B 3/04 241/257.1
5,419,252 A * 5/1995 Satake ..... B02B 3/04 99/519
5,773,066 A * 6/1998 Satake ..... B02B 1/04 426/483
8,783,588 B2 * 7/2014 Pape ..... B02C 9/02 241/12
9,114,400 B2 * 8/2015 Seto ..... B02B 3/04
9,427,740 B2 * 8/2016 Matthews ..... B02C 9/00
2001/0033885 A1 10/2001 Satake et al.

FOREIGN PATENT DOCUMENTS

JP 60-14945 A 1/1985
JP 63-178853 A 7/1988
JP 06-335634 A 12/1994
JP 07-171427 A 7/1995
JP 09-47674 A 2/1997
JP H11207194 A 8/1999
JP 2001-054741 A 2/2001

OTHER PUBLICATIONS

Second official action and additional search report, Mar. 17, 2016, App. No. 2013-80029472.3, State Intellectual Property Office of the People's Republic of China.
First official action and search report, Jul. 21, 2015, App. No. 2013-80029472.3, State Intellectual Property Office of the Peoples Republic of China.
First official action, Nov. 20, 2015, App. No. 10-2014-7032246, Korean Intellectual Property Office.
State Intellectual Property Office of the People'S Republic of China, First Official Action and Search Report in Pat. App. No. CN201380029472, dated Jul. 21, 2015, SIPO, Beijing City, China.

* cited by examiner

GRAIN-MILLING MACHINE

TECHNICAL FIELD

This invention relates to a grain-milling machine for milling grains such as rice or wheat, or for grinding the surface of resin pellets, coffee beans, or other granules.

BACKGROUND ART

It has been known hitherto that a rice-milling apparatus comprises a plurality of vertical abrasive rice-milling machines arranged in a row, a plurality of horizontal friction rice-milling machines arranged in a row, and any suitable number of polishing machines, the brown rice being milled through the rice-milling process by changing over channels between the rice-milling machines (refer to Patent Reference 1).

With this arrangement, an operator decides which rice-milling machine should be used and how many times brown rice should be passed through the rice-milling machines depending upon variety and quality of the rice, in order to finish the rice at the desired milling yield, embryo-stripping rate, and rice-milling degree.

It has also been known that a rice-milling apparatus includes an abrasive rice-milling process conducted in an abrasive rice-milling machine, which is followed by a friction rice-milling process conducted in a friction rice-milling machine, these rice-milling processes being arranged in series. In this rice-milling apparatus, there is provided a brown rice feed channel for feeding brown rice directly to the friction rice-milling process without going through the abrasive rice-milling process, by means of a channel change-over means (refer to Patent Reference 2).

Tests of characteristics of brown rice to be fed to the rice-milling apparatus have previously been carried out, and soft brown rice having good embryo-elimination is first fed to the abrasive rice-milling process to cut the waxy portion of the brown rice epidermis, thereby increasing the friction coefficient of the rice surface, and the bran layer is then removed from the rice grain in the friction rice-milling process under relatively low pressure for the rice milling. On the other hand, brown rice having bad embryo elimination is fed through the feed channel directly to the friction rice-milling process by the channel change-over means, and relatively high pressure is exerted on the rice grains in the friction rice-milling process to eliminate the entire embryo together with the tough embryo epidermis. In short, both rice grains having easy-to-remove embryos and rice grains having difficult-to-remove embryos can be milled to a high milling yield and high quality.

In those rice-milling apparatuses as disclosed in Patent References 1 and 2, however, because the means for changing over the channels between the rice-milling machines includes a large-sized bucket elevator and a channel change-over device located at the upper portion of the bucket elevator, work is required to remove rice grains which might be accumulated within the lower portion of the bucket elevator and the channel change-over device, prior to lot-changing. As a result, there is a problem with taking time to change a lot. In the conventional rice-milling apparatus, the plural rice-milling machines lead to a long rice-milling process, an increase in rice milling time, and poor economy, such as an increase in electricity costs. In the recent rice-milling field, it has been desired to provide energy-saving types of facilities, where a smaller lot size and a shorter flow lead to a reduction in the number of rice-milling processes, shortening of rice-milling time, and reduction in electricity costs.

PRIOR ART REFERENCE

Patent Reference

Patent Reference 1: Patent Public Disclosure 92861 Sho 60-14945

Patent Reference 2: Patent Public Disclosure Sho 63-178853

SUMMARY OF THE INVENTION

In the light of the above-mentioned problems, an object of the invention is to provide a grain-milling machine capable of reducing the time required for lot changing, as well as reducing electricity costs.

This object of the invention can be achieved by providing a grain-milling machine comprising a vertical abrasive grain-milling unit and a vertical friction grain-milling unit mounted on a pedestal, the abrasive grain-milling unit and friction grain-milling unit being located on upper and lower portions of the pedestal, respectively, the abrasive grain-milling unit including a milled grain discharge trough, the friction grain-milling unit including a grain feed trough to which the milled grain discharge trough of the abrasive grain milling unit is connected, and a two-way grain feed trough and change-over valve located above the abrasive grain-milling unit and capable of selectively feeding grains either directly to the friction grain-milling unit or to the friction grain-milling unit via the abrasive grain-milling unit.

The abrasive grain-milling unit includes a bran removal chamber, and a bran discharge trough located below the bran removal chamber through a pulley having a fan structure for generating air flow during rotation thereof, and the friction grain-milling unit includes a bran removal chamber to which the bran discharge trough of the abrasive grain-milling unit is connected, and a bran discharge trough located below the bran removal chamber of the friction grain-milling unit, through a pulley having a fan structure for generating air flow during rotation thereof, for collection and discharge of the bran from the abrasive and friction grain milling units, out of the apparatus.

According to a first aspect of the invention, the change-over valve for changing over the two-way grain feed trough to either of the grain-milling units comprises a rotary change-over valve which is simple in structure and makes it possible to make lot-change with simple operation. Because both the abrasive and friction grain-milling units are of the vertical feed type, accumulation of the rice grains is unlikely to occur in the grain-milling units, and as a result, the time required for lot-change can be reduced. Furthermore, an electric motor load required to feed grains can be reduced as compared with a bottom-up feed type and a horizontal feed type milling sections and thus, reduction in electricity costs is possible. Because the two-way feed trough located above the abrasive grain-milling unit leads to reduction in number of bucket elevators, reduction in installation space for the rice-milling facilities, and a short flow of the milling process is made possible.

According to a second aspect of the invention, the bran discharge trough is located below the bran removal chamber of the abrasive grain-milling unit, and through a pulley having a fan structure for generating air flow during rotation thereof, the bran discharge trough is also connected at its terminal end to the bran removal chamber of the friction grain-milling unit, and the bran discharge trough is located below the bran removal chamber of the friction grain-milling unit, through the pulley having a fan structure for generating air flow during rotation thereof, for collection and discharge of the bran from the abrasive and friction grain-milling units out of the machine. In more detail, bran from the bran removal chamber of the abrasive grain-milling unit is fed through the pulley and discharge trough to the bran removal chamber of the friction grain-milling unit and the bran from the bran removal chamber is discharged through the pulley and bran discharge trough below the bran removal chamber, out of the machine. Because the bran from both the abrasive and friction grain-milling units is downwardly gathered together for consolidated discharge thereof, a reduction in installation space for the rice-milling facilities and a shorter flow of the milling process are made possible.

BEST MODE FOR CARRYING OUT THE INVENTION

Figure 1:
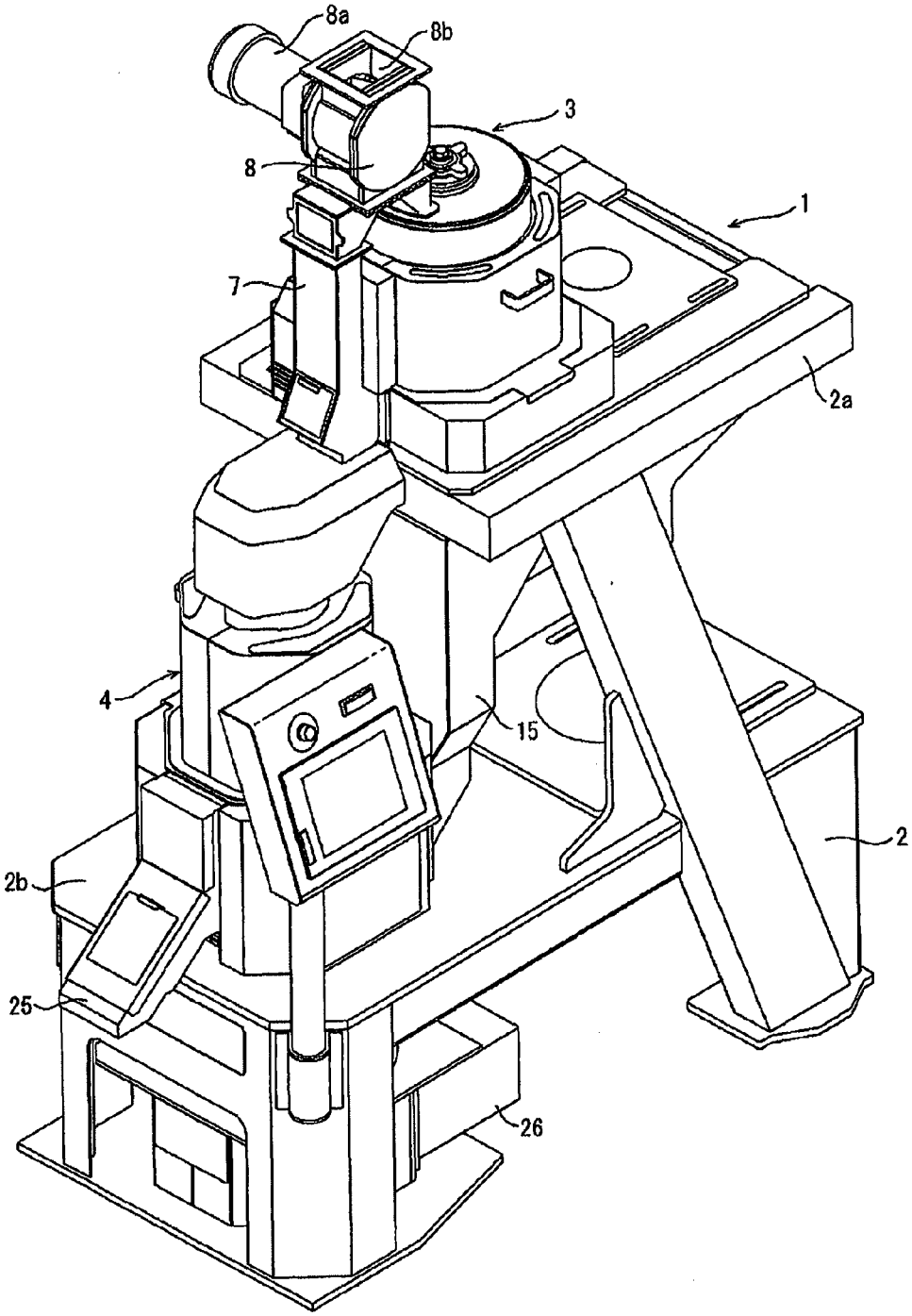
FIG. 1 is a perspective view of an entire grain-milling machine according to the present invention.

Referring to the accompanied drawings, the best mode for carrying out the invention will be described below. FIG. 1 is a perspective view of an entire grain-milling machine according to the present invention and FIG. 2 is a vertical sectional view of the grain-milling machine showing its interior structure.

Grain-milling machine 1 according to this invention is capable of milling grains such as rice or wheat or grinding the surface of resin pellets, coffee beans or other granules.

As shown in FIG. 1 of the accompanied drawings, a grain-milling machine 1 according to the invention includes a two-step pedestal 2 having its upper and lower portions 2*a* and 2*b* on which a vertical abrasive grain-milling unit 3 and a vertical friction grain-milling unit 4 are mounted, respectively. As can be seen in FIG. 2, the abrasive grain-milling unit 3 includes a milled grain discharge trough 5 connected to a grain feed trough 6 for the friction grain-milling unit 4. There is provided a rotary change-over valve 8 located above a two-way feed trough 7, which is capable of selectively feeding grains to be milled, directly to the friction grain-milling unit 4 or to the friction grain-milling unit 4 via the abrasive grain-milling unit 3.

Figure 2:
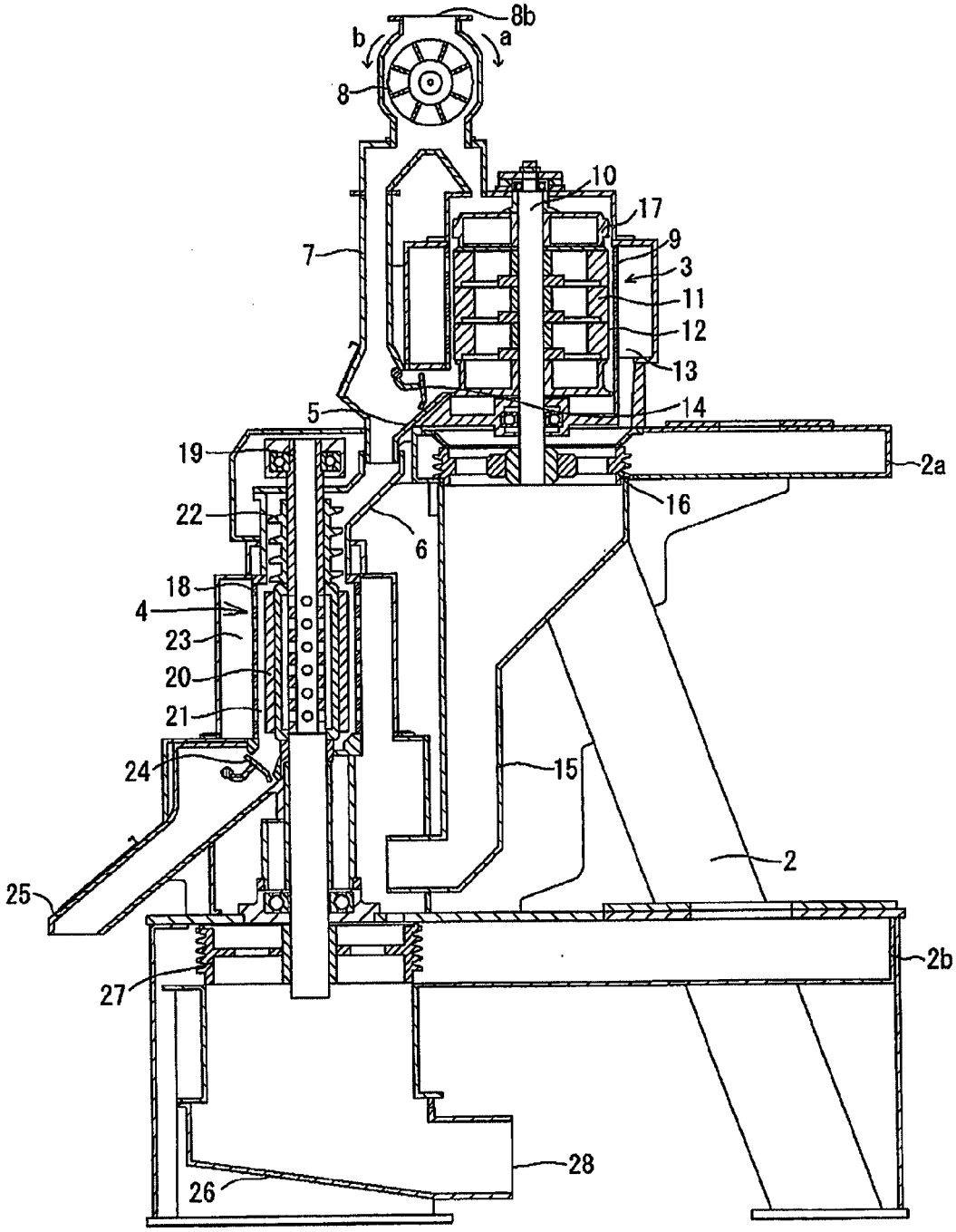
FIG. 2 is a vertical sectional view of the grain-milling machine showing its interior structure.

As can be seen in FIG. 2, the abrasive grain-milling unit 3 includes vertically extending cylindrical mesh screen 9 for removal of bran, a main shaft 10 mounted rotatively within the cylindrical mesh screen 9, a unitary abrasive roll body 11 consisting of a plurality of abrasive rolls fixedly secured to the main shaft 10, a milling chamber 12 defined between the cylindrical mesh screen 9 and the abrasive roll body 11, a feed screw roll 17 for feeding the grains to the milling chamber 12, a bran removal chamber 13 formed on the outer peripheral side of the cylindrical mesh screen 9 and a resistance plate 14 provided in a milled grain discharge portion below the milling chamber 12.

There is provided a bran discharge trough 15 associated with the abrasive grain-milling unit 3 and positioned below the bran removal chamber 13 such that it can collect bran separated from milled grains by the mesh screen 9. Mounted on the main shaft 10 in a communication between the bran discharge trough 15 and the bran removal chamber 13 is a pulley 16 which functions as a fan for generating air flow. The pulley 16 has a fan structure that is of the same structure as that disclosed in Japanese patent publication 2012-61453 filed by the present applicant and has two functions: to rotatively drive the main shaft on which the abrasive roll body 11 is mounted, and to generate air flow during rotation of the pulley by which the bran from the bran removal chamber is transferred to the bran discharge trough 15, the bran having been produced from the grains under the milling action of the abrasive roll body 11.

The bran discharge trough 15 is connected at its terminal end to a bran removal chamber in the friction grain-milling unit 3.

The friction grain-milling unit 4 includes a vertically extending cylindrical mesh screen 18 for removal of bran, a main shaft 19 mounted rotatively within the cylindrical bran removal mesh screen 18, a friction roll body 20 fixedly secured to the main shaft 19, a milling chamber 21 defined between the cylindrical bran removal mesh screen 18 and the friction roll body 20, a grain feed screw roll 22 for feeding grains to the milling chamber 21, a bran removal chamber 23 formed on the outer peripheral side of the cylindrical bran removal mesh screen 18, a resistance plate 24 located in a milled grain discharge portion below the milling chamber 21, and a milled grain discharge trough 25 for discharging the milled grains out of the machine against the resistance plate 24.

There is provided a bran discharge trough 26 associated with the friction grain-milling unit 4 and positioned below the bran removal chamber 23 such that it can collect bran separated from milled grains by cylindrical bran removal mesh screen 18. Mounted on the main shaft 19 in a communication between the bran discharge trough 26 and the bran removal chamber 23 is a pulley 27 similar to the pulley 16 as described above, which has a fan structure for generating air flow. A bag filter (not shown) is connected to an outlet opening 28 of the bran discharge trough 26 for collection of bran from the abrasive grain-milling unit 3 and the friction grain-milling unit 4 to discharge the bran out of the machine.

The grain-milling machine will be operated as follows.

It is determined that grains such as brown rice to be supplied into the inlet 8*b* of the feed trough 7, be either passed through the abrasive grain-milling unit 3 or fed directly to the friction grain-milling unit 4, taking into consideration variety and moisture content of rice, difficulty in embryo-stripping, and final milling degree obtained by a test of characteristics. Namely, in the case of rice grains of a variety having low hardness, high moisture content, or easy embryo-stripping characteristics, the rotary change-over valve 8 is rotated in a direction of arrow a (clockwise) by means of an electric motor 8*a* to feed the rice grains through the feed trough 7 to the inlet of the abrasive grain-milling unit 3. In the case where the grains are of brown rice, the waxy portion of the brown rice epidermis is first cut in the abrasive grain-milling unit 3 to increase the friction coefficient of the brown rice surface, and the rice milling is then carried out sufficiently at a low pressure in the friction grain-milling unit 4. By using the abrasive rice milling process at the initial stage, the lower pressurization does not result in generation of broken rice, the friction coefficient of the rice grain surface is increased, and the fine particle-like rice surface is then smoothed by the friction rice milling process.

In the abrasive grain-milling unit 3 according to the preferred embodiment of the invention, the main shaft 10 is rotated through the pulley 16 by means of a motor (not shown) and rotation of the feed screw roll 17 on the main shaft 10 permits grains to be fed to the milling chamber 12 in which the milling action is carried out, and in the case where the grains are brown rice grains, the waxy portion of the brown rice epidermis is cut by the abrasive stones of the abrasive milling roll body 11 to increase the friction coefficient of the rice surface. The rice grains which have been subject to the milling action are discharged through the milled rice grain discharge trough 5 against the action of the resistance plate 14 in the discharge portion of the abrasive grain-milling unit 3, and then fed through the feed trough 6 to the friction grain-milling unit 4.

In the friction grain-milling unit 4, the main shaft 19 is rotated through the pulley 27 by means of a motor (not shown) and rotation of the feed screw roll 22 on the main shaft 19 permits rice grains to be fed to the milling chamber 21 in which, by rotation of the friction roll body 20, the rice grains are subject to the mutual friction action so that low pressure milling is carried out in the milling chamber 21. Due to this fact, the rice grain surface is smoothed and the milled rice grains are discharged out of the machine through the milled rice discharge trough 25 against the action of the resistance plate 24 in the discharge portion of the friction grain milling unit.

In the case of grains having high hardness, low moisture grains, or poor embryo-stripping grains, the rotary change-over valve 8 is rotated in direction of arrow b (counter-clockwise) in FIG. 2 to feed rice grains through the feed trough 7 directly to the friction grain-milling unit 4. Upon milling in the friction grain-milling unit 4, the resistance plate 24 is set such that relatively high pressure can be exerted on the rice grains in the milling chamber for friction milling thereof, from the initial milling to the final milling. Thus, relatively high pressure-milling action is performed for stripping the entire embryo together with the tough embryo surface layer. The milled rice grains which have been discharged through the discharge trough 25 against the resistance plate 24 contain less broken rice, and finished as milled rice with a high yield and less embryo remaining.

In the grain-milling machine according to the preferred embodiment of the invention, the abrasive grain-milling unit 3 and the friction grain-milling unit 4 are located on the upper and lower portions of the pedestal 2, respectively, the milled grain discharge trough 5 of the abrasive grain-milling unit 3 is connected to the feed trough 6 of the friction grain-milling unit 4, and located above the abrasive grain-milling unit are the two-way feed trough 7 and the rotary change-over valve 8, which are capable of feeding the grains either directly to the friction grain-milling unit 4 or to the friction grain-milling unit 4 via the abrasive grain-milling unit 3, the rotary change-over valve being simple in structure and making it possible to make lot changes with simple operation. Because both the abrasive and friction grain-milling units are of the vertical feed type, accumulation of the rice grains is unlikely to occur in the grain-milling units, and so less work is required for removal of the accumulated rice, and as a result, the time required for lot changing can be reduced. Furthermore, the electric motor load required to feed grains can be reduced as compared with bottom-up feed type and horizontal feed type milling sections, and thus, reduction in electricity costs is possible. Because the two-way feed trough 7 located above the abrasive grain-milling unit leads to a reduction in the number of bucket elevators, reduction in installation space for the rice-milling facilities, and a shorter flow of the milling process is made possible.

The bran discharge trough 15 is located below the bran removal chamber 13 of the abrasive grain-milling unit 3, through the pulley 16 that functions as a fan during its rotation, which generates air flow. The bran discharge trough 15 is also connected at its terminal end to the bran removal chamber 23 of the friction grain-milling unit 4, for collection and discharge of the bran from the abrasive and friction grain-milling units out of the machine, the bran discharge trough 26 is located below the bran removal chamber 23 of the friction grain-milling unit 4 through the pulley 27 structured to function as a fan during its rotation, generating air flow. In more detail, bran from the bran removal chamber 13 of the abrasive grain-milling unit 3, is fed through the pulley 16 and discharge trough 15 to the bran removal chamber 23 of the friction grain-milling unit 4, and the bran from the bran removal chamber 23 is discharged through the pulley 27 and bran discharge trough 26 below the bran removal chamber 23, out of the machine. Because the bran from both the abrasive and friction grain-milling units 3 and 4 is downwardly gathered together for consolidated discharge thereof, a reduction in installation space for the rice-milling facilities and a shorter flow of the milling process are made possible.

The grain-milling machine according to the invention is not limited to the above-mentioned embodiment and it is contemplated that various changes may be made.

INDUSTRIAL APPLICABILITY

This invention may apply to milling of grains, grinding of resin pellets or coffee beans, or milling or grinding of other granules.

1 grain-milling machine
2 pedestal
3 abrasive grain-milling unit
4 friction grain-milling unit
5 milled grain discharge trough
6 feed trough for the friction grain-milling unit
7 feed trough
8 rotary change-over valve
9 cylindrical bran removal mesh screen
10 main shaft
11 abrasive roll body
12 milling chamber
13 bran removal chamber
14 resistance plate
15 bran discharge trough
16 pulley
17 screw feed roll
18 cylindrical bran removal mesh screen
19 main shaft
20 friction roll body
21 milling chamber
22 screw feed roll
23 bran removal chamber
24 resistance plate
25 milled grain discharge trough
26 bran discharge trough
27 pulley
28 bran outlet opening

The invention claimed is:

1. A grain-milling machine comprising:
a vertical abrasive grain-milling unit,
a vertical friction grain-milling unit,
a two-way grain feed trough, and
a change-over valve located above the two-way grain feed trough, wherein
the two-way grain feed trough is located above the abrasive grain-milling unit and the friction grain-milling unit,
the abrasive grain-milling unit is located above the friction grain-milling unit, the abrasive grain-milling unit and the friction grain-milling unit are top-down vertical feed units, the abrasive grain-milling unit includes a milled grain discharge trough, the friction grain-milling unit includes a grain feed trough to which the milled grain discharge trough of the abrasive grain milling unit is connected, and the change-over valve selectively feeds grains in the two-way grain feed trough in a vertical feed direction either directly to the friction grain-milling unit or directly to the abrasive grain-milling unit.

2. A grain milling machine according to claim 1, wherein the abrasive grain-milling unit comprises a bran removal chamber, a bran discharge trough located below the bran removal chamber, and a pulley having a fan structure to generate air flow during rotation thereof, the pulley being interposed between the bran removal chamber and the bran discharge trough, and the friction grain-milling unit comprises a bran removal chamber to which the bran discharge trough of the abrasive grain-milling unit is connected, a bran discharge trough located below the bran removal chamber of the friction grain-milling unit for collection and discharge of bran from the abrasive and friction grain-milling units, and a pulley having a fan structure to generate air flow during rotation thereof, the pulley being interposed between the abrasive and friction grain-milling units.

* * * * *